United States Patent [19]

Youngblood

[11] Patent Number: 4,913,061

[45] Date of Patent: Apr. 3, 1990

[54] AUTO RACK SIDE PANEL SUPPORT SYSTEM

[76] Inventor: Bernard J. Youngblood, 477 Allard Rd., Grosse Pointe Farms, Mich. 48236

[21] Appl. No.: 250,012

[22] Filed: Sep. 27, 1988

[51] Int. Cl.[4] ..... B61D 17/00

[52] U.S. Cl. ..... 105/378; 49/463; 105/355; 410/26

[58] Field of Search ..... 105/355, 378, 377, 379, 105/258; 410/26, 27, 28, 28.1, 4, 5, 3, 7–8, 13, 24; 49/463, 464, 466; 296/181, 148, 155, 1.1

[56] References Cited

U.S. PATENT DOCUMENTS

| | | | |
|---|---|---|---|
| 3,677,193 | 7/1972 | Pringle | 105/378 X |
| 3,739,906 | 6/1973 | Cwycyshyn et al. | 410/26 X |
| 3,801,177 | 4/1974 | Fylling et al. | 410/26 X |
| 3,815,517 | 6/1974 | Przybylinski | 410/26 |
| 3,895,587 | 7/1975 | Bell | 410/26 |
| 4,067,469 | 1/1978 | Biaggini et al. | 410/13 X |
| 4,116,135 | 9/1978 | Jaekle et al. | 410/26 |
| 4,318,349 | 3/1982 | Galasan | 105/378 |
| 4,343,401 | 8/1982 | Paulyson | 410/26 X |
| 4,668,142 | 5/1987 | Fity et al. | 410/26 |

OTHER PUBLICATIONS

Letter of Nov. 30, 1987, from Leavitt A. Peterson of Association of American Railroads, Mechanical Division, Manual of Standards and Recommended Practices, RE; Specification M-970-87; Certificate of Multi--Level Autorack Cars; Standard, Adopted, 1987, Effective Jan. 1, 1988; 11 pages.

Brochure, "The Ultimate Coating for Metal", copyrighted 1987 Atochem Inc., Polymers Division located at P.O. Box 607, Glen Rock, N.J., 07452, pp. 1-9.

Brochure entitled "Rilsan Coating Techniques", of Atochem located at 4, cours Michelet, La Defense 10-Cedex 42, 92091 Paris La Defense, France, pp. 1-39.

*Primary Examiner*—Douglas C. Butler

*Attorney, Agent, or Firm*—Dykema Gossett

[57] ABSTRACT

Automobiles are transported on train cars called auto racks. These auto racks are covered by galvanized steel panels that are mounted by brackets to the auto rack frame. The brackets and frame are typically formed of a metal other than galvanized steel and the interface between the two metals cause the panels to rust and crack. Applicant has solved this problem by coating the brackets with a nylon coating that prevents the panels from rusting. Brackets that are to be welded to the frame are left uncoated at their weld points but are coated elsewhere. The invention results in an auto rack panel support system that will prevent rusting of the side panels and allow them to be used for longer periods of time.

5 Claims, 1 Drawing Sheet

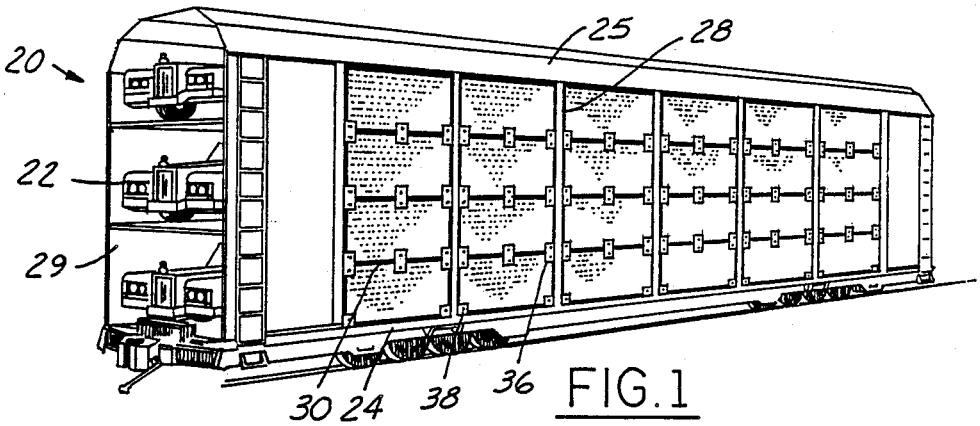
FIG.1
FIG.2 PRIOR ART
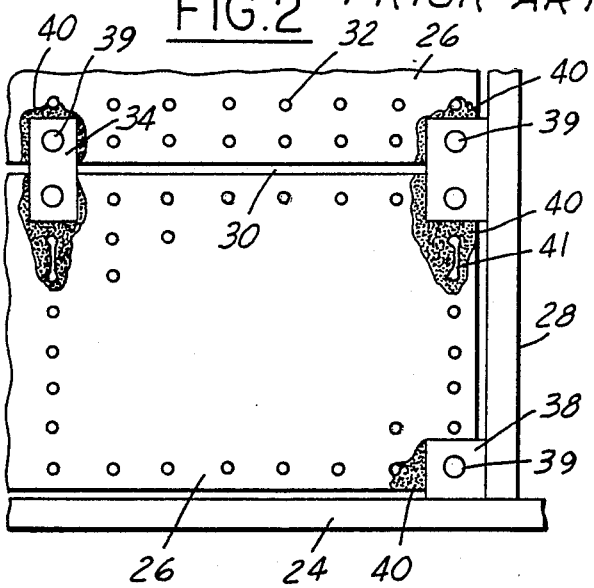
FIG.3
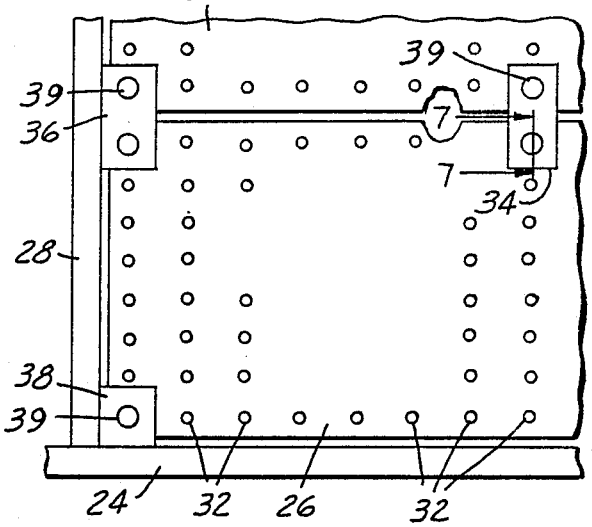
FIG.4
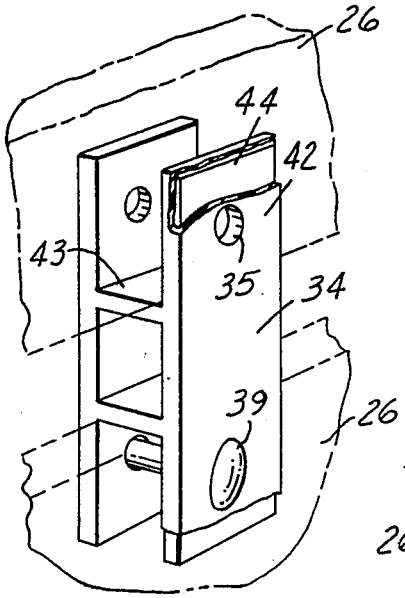
FIG.5
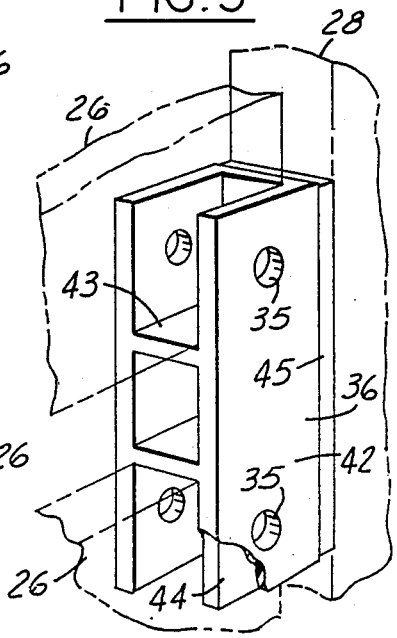
FIG.7
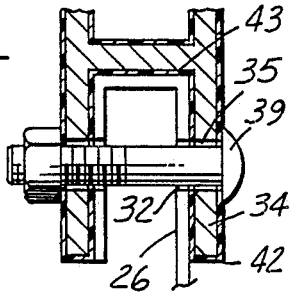
FIG.6
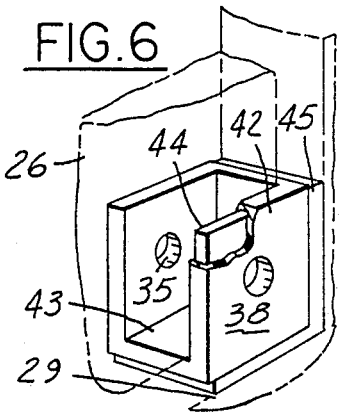

AUTO RACK SIDE PANEL SUPPORT SYSTEM

FIELD OF THE INVENTION

This invention relates to an auto rack side panel support system used on auto rack train cars for transporting new automobiles.

BACKGROUND OF THE INVENTION

Automobiles are transported in volume on auto rack train cars. The racks usually consist of stacked long beds that support the automobiles and vertical bars that interconnect the beds. Problems were encountered with these racks since they left the automobiles exposed. Vandals threw rocks through the gaps between the bars. Also, rocks could come up from the road and strike the automobiles. This rock damage could be repaired, but it is quite expensive. Additionally, consumers are notoriously picky about the purchase of a new automobile and do not want to purchase an automobile that has already had some surface damage, regardless of the amount.

To correct these problems, galvanized steel panels are placed between the bars of the train car to block access to the automobiles. The beds, the bars and the brackets that support the side panels are made from metals other than galvanized steel, often, steel or aluminum. Problems arise at the contact points between the galvanized steel panels and the other members. The galvanized panels rust near the contact points due to the contact with the different metals and crack. Since the panels are perforated, a small crack can open a relatively large hole and the purpose of the panels is defeated since there is again access to the car. The rust forms localized weakened spots that cause the panels to bend. This has been a major problem in the automobile industry and has been commented on in the literature. In fact, the mandatory standards adopted by the Association of Americal Railroads, require replacement or repair of any bent or rusted panels and replacement of any cracked or broken panels, that proves very expensive.

The mandatory standards at section 2.3.2 describe mandatory maintenance procedures for the side panels:

2.3.2(d) Replace or repair side screens or panels which are bent inward or outward in excess of 2".

2.3.2(e) Replace any cracked or broken side screens or panels.

2.3.2(f) Enclosed cars equipped with side panels corroded to the extent of loose or flaking rust must be recoated or replaced.

THE PRIOR ART

As can be seen from FIG. 1, the auto rack 20 supports automobiles 22 and is adapted to be connected as a train car. Panels 26 cover the sides of the auto rack. The rusting problem is illustrated in prior art, FIG. 2 which shows panels 26 being supported on brackets 34, 36 and 38. Rust areas 40 form on the panels 26 starting at the contact points with the brackets and corrode, bend and crack the panels. The panels 26 have a pattern of apertures 32 and a crack is shown at 41 connecting two apertures to create a relatively large opening.

In the past there have been attempts to cover the brackets with paint. This hasn't proved successful since the paint flakes and chips off and the rusting soon occurs again.

It was also known to coat various industrial members with a mylon coating to prevent rusting. However, this wasn't known in auto rack side panel support assemblies. It also wasn't known in the bracket art. That is, it wasn't known to coat a bracket to prevent rusting of the member the bracket holds.

SUMMARY OF THE INVENTION

Applicant has solved the rusting problem by coating the bracket with a tough cover. Applicant coats the bracket with a nylon compound that won't normally flake or chip. By coating the bracket with nylon, Applicant prevents rusting of the panels and saves a great deal of maintenance work and expense.

BRIEF DESCRIPTION OF THE DRAWINGS

FIG. 1 is a perspective view showing an auto rack that utilizes a side panel support system as disclosed in the present invention.

FIG. 2 is an enlarged partial view of the brackets used by the prior art to support the side panels.

FIG. 3 is an enlarged partial view of the brackets used by the present invention to support the side panels.

FIG. 4 is a perspective view of the spacer bracket as disclosed by the present invention supporting two side panels.

FIG. 5 is a perspective view of a side bracket as disclosed by the present invention supporting two side panels.

FIG. 6 is a perspective view of a corner bracket as disclosed by the present invention supporting a side panel.

FIG. 7 is a cross-section along line 7'7 in FIG. 3 showing a bolt member used in the present invention to secure a panel to a bracket.

DESCRIPTION OF THE PREFERRED EMBODIMENT OF THE INVENTION

As explained above, the drawings generally show an auto rack 20 for transporting vehicles 22. The auto rack consists of a frame that includes horizontal members 24, a roof 25 and vertical bars 28. Side panels 26 are disposed in the area between the vertical bars 28, the horizontal members 24 and the roof 25 and are perforated by a pattern of apertures 32. The front face 29 of the auto rack 20 could also be provided with panels to close the opening.

There are three types of brackets shown supporting the side panels 26 in the drawings. However, the invention is not intended to be limited to any specific type of bracket, the illustrated brackets are merely shown as examples. The invention is intended to include any bracket used in the claimed environment.

The brackets illustrated are spacer bracket 34, side bracket 36 and corner bracket 38. These brackets are all to be coated with a nylon coating compound 42. An example of a desirable coating is Rislan TM available from, and described in brochures published by, Auto Chem, Inc., Polymers Division, located in Glen Rock, New Jersey. The brochures also disclose a preferable coating technique. However, it is to be understood that the invention is intended to include other synthetic coatings and coating techniques.

As shown in FIG. 4, the spacer bracket 34 is configured to interconnect two side panels 26 that abut faces 43. The spacer bracket 34 is formed from a material 44 that is preferably metal, and is coated with a nylon coating 42. Bolt holes 35 extend through the bracket 34 and are coated on their interior surface with the nylon coating. These bolt holes 35 should be formed radially smaller than the apertures 32 formed in the panel 26. A bolt 39 is shown mounted in the hole 35 and is described below.

As shown in FIG. 5, a side bracket 36 is welded to the vertical bar 28 and also acts to support two side panels 26 on faces 43. The side panel is formed of a material 44 that includes a first coated portion 42 that is in contact with the panels 26, and a second uncoated portion 45 that is to be welded to the vertical bar 28. The side panel bracket 36 has bolt holes 35 that are identical to the bolt holes 35 disclosed with the spacer bracket 34.

FIG. 6 shows the corner bracket 38 being welded to both the vertical bar 28 and the horizontally extending member 29, and supporting a panel 26 on face 43. The corner bracket 38 is formed from a metal 44 that is coated with a nylon coating 42 at a first portion and has a second uncoated portion 45 along the areas of the bracket 38 that will be welded to the members 28, 29. The corner bracker 38 has a bolt hole 35 identical to the bolt hole 35 disclosed with the spacer bracket 34.

Since the bolt holes 35 are formed radially smaller than the apertures 32 a bolt 39 could pass through the bolt hole 35 and through the aperture 32 and support the panel 26 without actually being in contact with the panel 26. This is shown in FIG. 7. Due to the fact that the bolt 39 will not be in contact with the panel 26 it need not be coated by the nylon coating. The bolt holes 35 are formed on the bracket at a height above face 43 that would correspond to an aperture 32 formed in the panel 26. Although FIG. 7 shows the bolt 39 being used with a spacer bracket, it is to be understood that all of the brackets would have this feature.

A technique for preventing rust from forming on the side panels of an auto rack has been disclosed. However, the disclosed embodiment is not meant to be limiting to the invention and a worker in the art will realize that certain modifications would be within the scope of the invention. For instance, a different coating material than that disclosed could be used. The intended scope of the disclosed invention can be understood upon a consideration of the following claims.

I claim:

1. An auto rack for transporting automobiles which comprises:

a main frame including at least one generally horizontally extending member being capable of supporting automobiles and several bar members extending vertically upward from said horizontally extending member;

panel sections covering the area between the bar members and the horizontally extending member;

bracket members to connect the panel sections to the horizontally extending member and the bar members, the bracket members being in contact with the panel sections; and the portions of said bracket members that contact the panel sections being coated by a synthetic coating to provide surface to surface contact between the panel sections and the coated bracket members thereby retarding corrosion which could occur between the panel sections and the bracket members if the bracket members were not coated by the synthetic coating.

2. An auto rack for transporting automobiles as recited in claim 1, and further within the panel sections are perforated and made of a galvanized steel.

3. An auto rack for transporting automobiles as recited in claim 2, and further wherein the horizontally extending member, the bar members and the bracket members are made of a metal other than galvanized steel.

4. An auto rack for transporting automobiles as recited in claim 2, and further wherein said bracket members are formed with bolt holes, and a bolt member passes through the bolt hole and a panel perforation to secure the panel sections to the bracket members, and said bolt holes are positioned and sized so that said bolt member doe not contact the corresponding panel section but passes cleanly through the perforation.

5. An auto rack for transporting automobiles as recited in claim 1, and further wherein at least some of the bracket members are welded to one of the horizontally extending member bar members and the weld area on the bracket member is not coated with the synthetic coating.

* * * * *